United States Patent [19]

Bellman et al.

[11] Patent Number: 4,583,096

[45] Date of Patent: Apr. 15, 1986

[54] FIBER OPTIC DATA DISTRIBUTION FOR PHASED ARRAY ANTENNA

[75] Inventors: Brian M. Bellman; Ronald G. Kraus, both of Severna Park, Md.

[73] Assignee: The United States of America as represented by the Secretary of the Air Force, Washington, D.C.

[21] Appl. No.: 497,444

[22] Filed: May 23, 1983

[51] Int. Cl.[4] ..... H01Q 3/22; H01Q 3/00

[52] U.S. Cl. ..... 343/368; 343/376

[58] Field of Search ..... 343/368, 371, 373, 375, 343/376; 455/611, 608, 610; 350/96.16, 96.24

[56] References Cited

U.S. PATENT DOCUMENTS

| | | | |
|---|---|---|---|
| 3,245,081 | 4/1966 | McFarland | 343/375 |
| 3,979,750 | 9/1976 | Smith | 343/376 |
| 4,028,702 | 6/1977 | Levine | 343/100 SA |
| 4,313,226 | 1/1982 | Blackington | 350/96.13 |
| 4,387,953 | 6/1983 | Shirasaki et al. | 350/96.13 |
| 4,420,842 | 12/1983 | Kuhn | 455/608 |

FOREIGN PATENT DOCUMENTS

| | | | |
|---|---|---|---|
| 0107607 | 7/1982 | Japan | 343/368 |

OTHER PUBLICATIONS

*Electromagnetic Concepts & Applications,* Skitek and Marshall, 1982, pp. 449–451.

*Primary Examiner*—Theodore M. Blum
*Assistant Examiner*—Gregory C. Issing
*Attorney, Agent, or Firm*—Donald J. Singer; Bernard E. Franz; John R. Flanagan

[57] ABSTRACT

A fiber optic data distribution system is disclosed for distribution of the phase shift commands to an electronically steered antenna array. Novelties include the fan-out of a single bundle to multiple receptors, equalization of optical path for precise synchronization, the use of the RF active side of the antenna for data distribution, the use of the antenna radome as support structure for the fiber optics, and an optical reflector to divert light from the plane of the radome to the transmit/receive element.

4 Claims, 4 Drawing Figures

FIBER OPTIC DATA DISTRIBUTION FOR PHASED ARRAY ANTENNA

RIGHTS OF THE GOVERNMENT

The invention described herein may be manufactured and used by or for the Government of the United States for all governmental purposes without the payment of any royalty.

BACKGROUND OF THE INVENTION

This invention relates to control of phased array systems generally, and more particularly to distribution of data to the individual element modules for controlling the phase shifters.

The prior art in respect to phased array antennas and the technique for generating the required multi-phase excitation signals in controllable fashion, are extensively described in the technical literature. The text "Radar Handbook" by Merrill I. Skolnik, (McGraw Hill 1970) provides considerable insight and background information in respect to the design of phased array systems.

In general, a phased array, which provides maximum scanning flexibility and random, inertialess, beampointing capability, involves the individual excitation of the radiating elements of the arrays, or at least individual rows or columns of elements treated discretely in respect to the phase of the RF excitation thereof. In some of the most advanced and most flexible phased array systems, two-dimensional arrays, such as planar arrays, are used which require individual excitation of all of the elements in order to provide a pencil-beam with pointing flexibility desired throughout a solid angle of coverage.

What may be referred to as the classical approach to the problem involves the use of controllable individual radio frequency phase shifters between the source of transmittable RF, and each of the aforementioned array radiating elements (antenna elements). Chapter 12 of the aforementioned Radar Handbook reference describes known types of controllable phase shifters available for the purpose. These include the so-called ferrite phase shifters, and those employing semiconductor diodes. The former can provide either stepped or continuously variable phase shift within recognized limits in response to a digital or analog type control signal, whereas the latter generally provide phase shift in discrete steps (usually digitally controlled). The manner of digital or analog control is explained in the text aforementioned.

U.S. Pat. No. 4,028,702 to A. M. Levine describes a phased array system using fiber optic delay lines to provide the actual phase shift devices, using light energy modulated by an RF signal. The use of fiber optic lines for communications, including transmission of digital data, is well known. Examples of fiber optic transmission links are shown, for example in U.S. Pat. Nos. 4,052,611; 4,135,202; 4,160,157 and 4,201,909. A text "Fiber Optics" by Edward A. Lacy, 1982, describes components and systems of fiber optics for communications.

Phased array antennas can be electronically steered by controlling the phase of the RF signal at each transmit/receive element. Conventionally a digitally controlled phase shifter at each element implements this phase control. It is customary for the radiating elements to be laid out with a regular spacing on a two-dimensional surface, for example a uniform rectangular grid in the XY plane, comprising rows and columns of radiators. As is well known, the antenna beam can be steered in one direction by applying a relative phase shift between rows and in an orthogonal dimension by applying a relative phase shift between columns. At the element, the row (Y) and column (X) phase change commands are added to give a single control to the phase shifter.

The magnitude of the problem of distributing the data can be appreciated when the requirements of modern agile beam antennas are considered. It is not unusual to have 100 rows and 100 columns, with an 8-bit command word to be communicated in one microsecond. The need to remove an element for maintenance means that four connectors (X, Y, male, female) are required at each of 10,000 elements. Access to the elements of the array is further complicated by the requirement to distribute other services such as RF power for transmission, RF signal on reception, DC power for logic etc., and possibly a cooling medium.

In addition to communicating data in the form of a multiple bit word, synchronization data in the form of a timing pulse precise to a few nanoseconds, is required in a specialized application of agile beam radars. It is usually required that the delay times in the distribution paths of this pulse be equal to all receptors.

SUMMARY OF THE INVENTION

An object of the invention is to simplify and improve the distribution of the data commands in a phased array system. Another object is to provide a system which simplifies removal of an element for maintenance. Still another object is to improve the precision of supplying synchronization data.

The invention is based on fiber optic distribution of data. Digitally encoded data drives an optical light source which illuminates a bundle of fibers. A fiber from this bundle is terminated in the vicinity of each element on one row of the array. A photosensor on the transmit/receive element receives the modulated light signal. No physical contact between fiber end and receptor is required. A similar but independent, light source and fiber optic bundle is provided for every row of the array. Similar sources and fiber optic bundles are independently provided for every individual column of the array.

DETAILED DESCRIPTION

Figure 1:
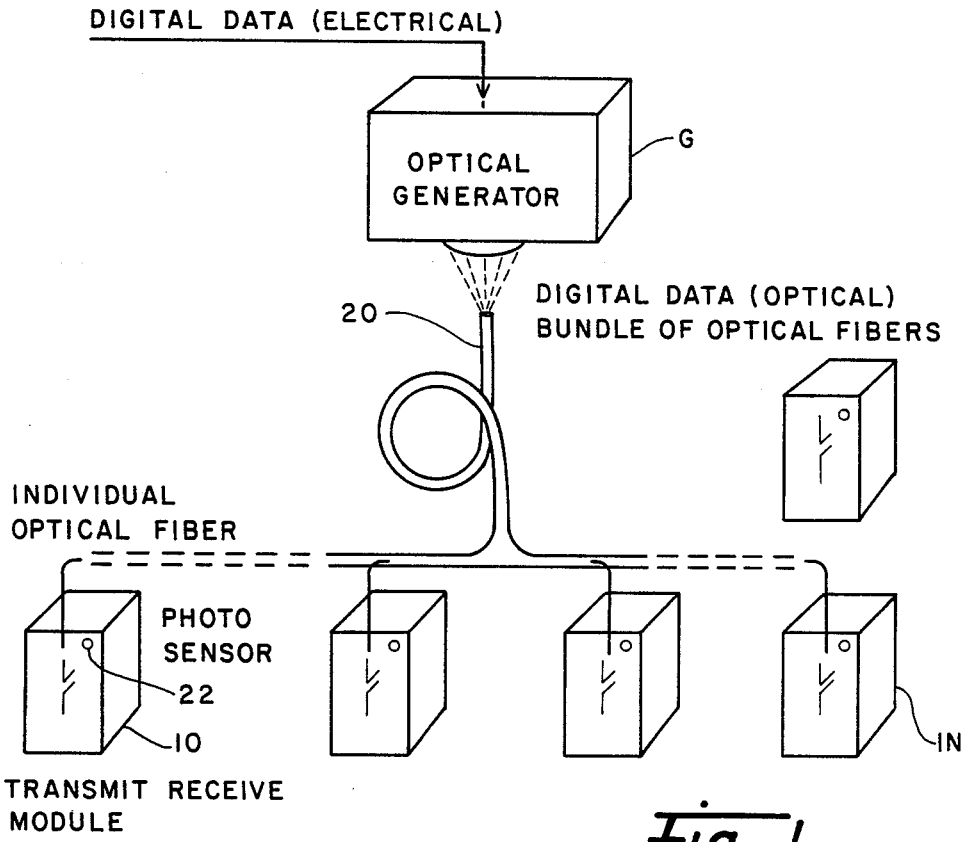
FIG. 1 is a symbolic diagram showing one form of the invention.

FIG. 1 illustrates a specific embodiment of the invention. An optical source G, say an injection diode laser, is modulated in accordance with the data, say an 8-bit serial word required to command phase shift of all (say 100) elements 10 to IN in one row of the array. A bundle 20 of 100 optical fibers, illuminated by this source, is routed alongside a row of antenna transmit/receive elements with one fiber being led off from the bundle towards each element. A photosensitive receptor 22 on the element, in the vicinity of the termination of the single fiber from the bundle, receives the data and transmits it to the elements own processor for addition to the column (X) data and subsequent control of the element phase shifter.

Figure 2:
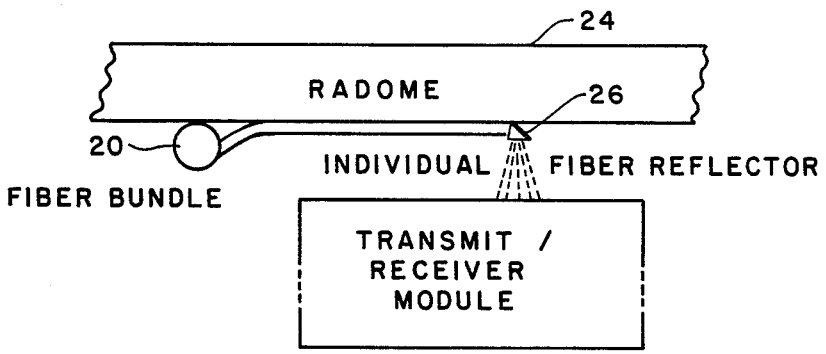
FIG. 2 illustrates one form of optical connector between the fiber and receptor on an element.

FIG. 2 illustrates one possible form of optical connector between the fiber and receptor on the element. The fiber bundle 20 is attached to or built into the radome plate 24 which covers the front (RF) surface of the antenna. A prism or reflector 26 at the end of the fiber allows the somewhat delicate fiber to be supported on the plane plate but radiate perpendicularly from the plate. The optical fiber, being a nonconductive dielectric, will not disturb the RF field as a conductive coax cable would, and allows use of the front, RF, side of the array for distribution. The noncontact form of connector facilitates replacement of the element and has potential for lightweight low cost design. The distance between the reflector on the radome and the photoreceptor on the module may be $\frac{1}{4}$ to one inch.

Figure 3:
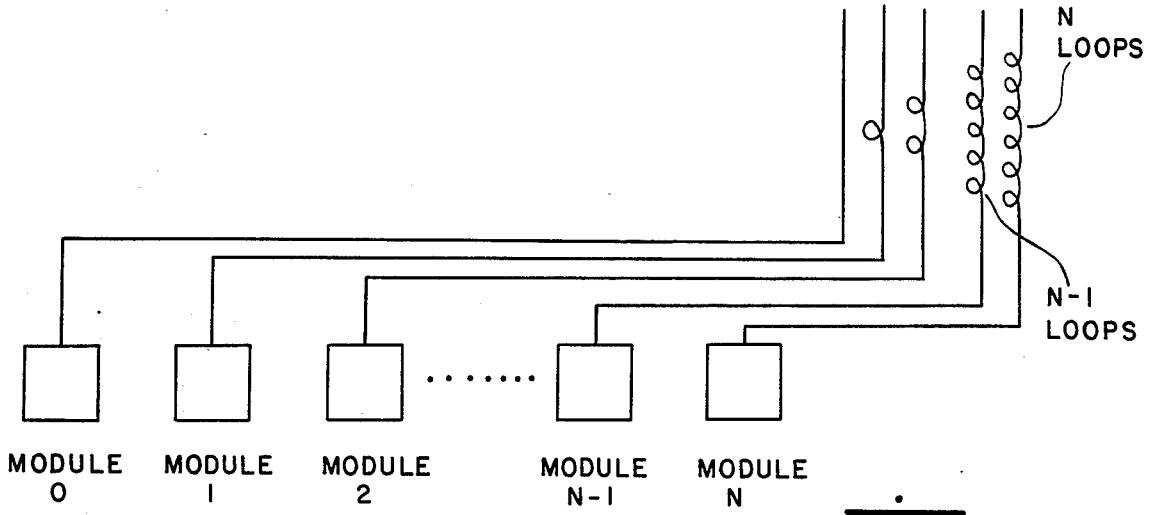
FIG. 3 illustrates symbolically how the length of every fiber in a bundle may be made the same.

FIG. 3 illustrates schematically how the length of every fiber in the bundle may be made the same, so assuring that a synchronization pulse from the optical source will be precisely simultaneously received at all elements. In this schematic, the length of fiber in one circumference of the loop should equal the spacing between elements.

Figure 4:
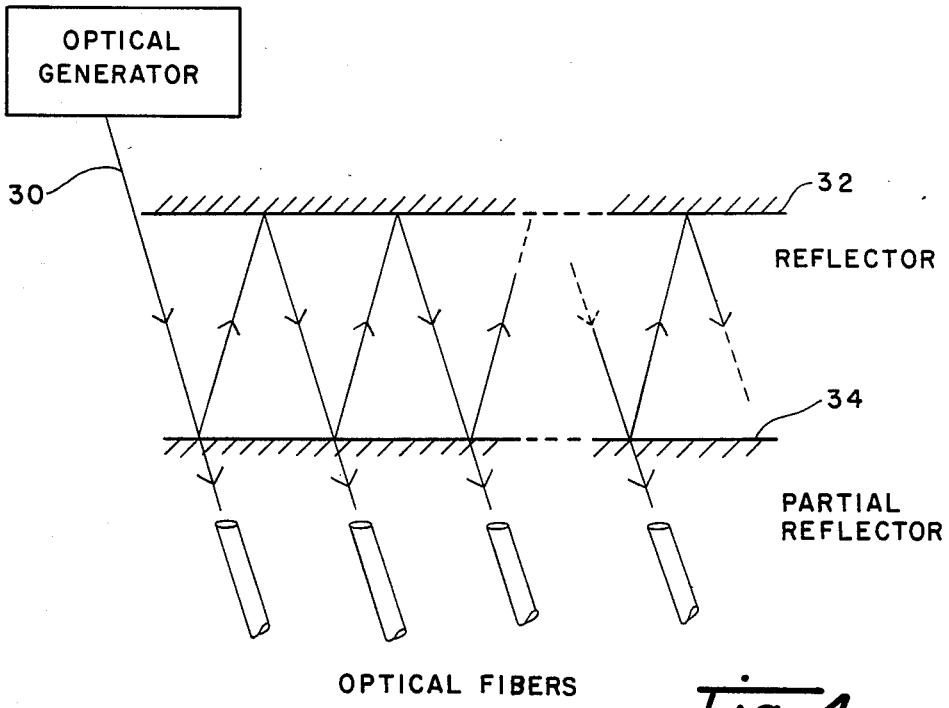
FIG. 4 illustrates an alternative form of providing for the generation of uniformly increasing time delays between signals on fibers.

FIG. 4 illustrates an alternative method of mechanising the generation of uniformly increasing time delays between signals on fibers. The modulated light beam 30 is propogated down an optical delay line comprising two parallel reflectors 32 and 34. At each reflecting point a small fraction of the light beam is tapped-off (coupled) into one of the fibers. The delay between signals in adjacent optical taps is equal to the time taken to traverse the path between taps.

Thus, while preferred constructional features of the invention are embodied in the structure illustrated herein, it is to be understood that changes and variations may be made by the skilled in the art without departing from the spirit and scope of my invention.

We claim:

1. A data distribution arrangement for supplying data commands to individual modules for controlling phase shift in a two-dimensional phased array system having a plurality of antenna elements forming rows and columns, with each element having an associated individual module which includes a phase shift device, wherein a radome plate covers the front (RF) surface of the antenna array, the data distribution arrangements being separate from transmission lines coupled to the modules for transmission of RF signals or signals converted to or from RF signals;

wherein said data distribution arrangement comprises a plurality of optical fibers organized into bundles, each fiber having an input end an an output end, a plurality of optical generators, each of which includes modulation means for generating an optical beam modulated with digital data commands, there being one of said optical generators for each row and one for each column, with one of said bundles associataed with each optical generator for supplying data to all modules of the corresponding row or column;

input coupling means for coupling said beam from each optical generator to the input ends of all of the fibers in the corresponding bundle, each bundle being routed alongside its row or column and supported by the radome plate, with one optic fiber being supported by the radome plate and led off from the bundle towards each module in that row or column;

output coupling means for coupling light output from the output end of each individual fiber to the corresponding module, including two photosensors located in each module for receiving data from two fibers, one for the row and the other for the column, each photosensor being located adjacent to the output end of the individual fiber, without any individual mechanical coupling between the fiber and the module, and reflecting means located near the output end of each fiber for changing the direction of the light output, permitting the fiber to be supported by the radome plate but to radiate perpendicular to the radome plate and directing the light toward the photosensor, the amount of phase shift in the phase shifter of each module being a function only of the digital data commands for the row and column combined and independent of the lengths of the optical fibers.

2. A data distribution arrangement according to claim 1, which includes means for assuring that a synchronization pulse from all of the optical generators will be precisely simultaneously received at all modules.

3. A data distribution arrangement according to claim 2, wherein said means for assuring comprises loops in the fibers except the first, with the second fiber having one loop, and each fiber having one more loop than the preceding fiber, with one circumference of the loops being equal to the spacing between elements.

4. A data distribution arrangement according to claim 2, wherein said means for assuring is an optical delay line comprising two parallel reflectors, one of which is a partial reflector, and at each reflecting point along the partial reflector a small fraction of the light beam passing through the partial reflector is tapped off into one of the fibers of a bundle.

* * * * *